US012435717B2

(12) United States Patent
Tuckey

(10) Patent No.: US 12,435,717 B2
(45) Date of Patent: Oct. 7, 2025

(54) ROTARY PUMP OR MOTOR WITH IMPROVED INTAKE, EXHAUST, VANE AND BEARINGLESS SLEEVE FEATURES

(71) Applicant: Charles H. Tuckey, Cass City, MI (US)

(72) Inventor: Charles H. Tuckey, Cass City, MI (US)

( * ) Notice: Subject to any disclaimer, the term of this patent is extended or adjusted under 35 U.S.C. 154(b) by 0 days.

(21) Appl. No.: 17/822,546

(22) Filed: Aug. 26, 2022

(65) Prior Publication Data

US 2023/0083167 A1 Mar. 16, 2023

Related U.S. Application Data

(60) Provisional application No. 63/237,545, filed on Aug. 27, 2021.

(51) Int. Cl.
*F04C 2/44* (2006.01)
*F01C 1/44* (2006.01)
(Continued)

(52) U.S. Cl.
CPC ..... *F04C 2/44* (2013.01); *F01C 1/44* (2013.01); *F01C 21/0809* (2013.01); *F04C 5/00* (2013.01);
(Continued)

(58) Field of Classification Search
CPC ..... F04C 2/44; F04C 18/344; F04C 28/14; F04C 29/00; F04C 18/356; F04C 18/44;
(Continued)

(56) References Cited

U.S. PATENT DOCUMENTS 1,842,829 A * 1/1932 Gregg ..... F04C 18/44 418/265
2,537,502 A 1/1951 Yingling
(Continued)

FOREIGN PATENT DOCUMENTS

DE 3423276 A1 1/1986
DE 3344181 A1 4/1992
(Continued)

OTHER PUBLICATIONS

WO-2016189801-A1, English Language Machine Translation (Year: 2016).*

*Primary Examiner* — Wesley G Harris
(74) *Attorney, Agent, or Firm* — Robert L. Stearns; Dickinson Wright PLLC

(57) ABSTRACT

A vane pump or motor assembly includes a housing having an inner cavity with an inner wall disposed about a first central axis. A rotor is disposed in the inner cavity and is rotatable about a second axis that is offset from the first axis to create a variable width space between the rotor and the inner wall. plurality of vanes are moveably carried by the rotor and engage the inner wall to partition the variable width space into a plurality of chambers of increasing and decreasing volume in response to rotating the rotor. Each vane is in the form of a leaf vane having a mounting end formed with a hook portion and wherein the rotor includes corresponding recesses with latch portions that engage of each respective hook portion and supports the leaf vanes for outward swinging movement relative to the rotor for engaging the inner wall of the inner cavity.

13 Claims, 15 Drawing Sheets

(51) Int. Cl.
*F01C 21/08* (2006.01)
*F04C 5/00* (2006.01)
*F04C 18/44* (2006.01)
*F04C 29/12* (2006.01)

(52) U.S. Cl.
CPC ..... *F04C 18/44* (2013.01); *F04C 29/12* (2013.01); *F04C 2240/20* (2013.01)

(58) Field of Classification Search
CPC ..... F04C 29/12; F04C 2240/20; F04C 5/00; F01C 21/0809; F01C 1/44; F01D 17/162; F04D 29/563
USPC ..... 16/268, 269
See application file for complete search history.

(56) References Cited

U.S. PATENT DOCUMENTS 2,753,809 A * 7/1956 Garrison ..... F04C 5/00 418/113
3,096,932 A * 7/1963 Traylor, Jr. ..... F04C 5/00 418/179
3,211,103 A 10/1965 Kiekhaefer
3,348,259 A * 10/1967 Wilhelmsen ..... E05D 1/06 16/269
3,886,764 A * 6/1975 Edwards ..... F25B 9/004 62/401
4,057,165 A * 11/1977 Kardell ..... B65D 19/18 16/268
4,451,215 A 5/1984 Winkler et al.
4,852,213 A * 8/1989 Shewchuk ..... E05D 9/005 16/385
6,126,423 A * 10/2000 Freeland ..... F04C 27/001 418/109
2010/0064718 A1* 3/2010 Blomquist ..... H01L 23/467 62/401
2015/0369245 A1 12/2015 Kwak et al.
2016/0312783 A1* 10/2016 Tirgovet ..... F16K 15/16

FOREIGN PATENT DOCUMENTS

EP 1384005 B1 * 11/2005 ..... F01C 21/0809
WO WO-2016189801 A1 * 12/2016 ..... F04C 18/3441

* cited by examiner

ROTARY PUMP OR MOTOR WITH IMPROVED INTAKE, EXHAUST, VANE AND BEARINGLESS SLEEVE FEATURES

CROSS-REFERENCE TO RELATED APPLICATION

This U.S. Utility patent application claims priority to U.S. Provisional Patent Application No. 63/237,545, filed Aug. 27, 2021, the entire contents of which are incorporated herein by reference.

BACKGROUND OF THE INVENTION

1. Technical Field

This invention related generally to positive displacement rotary pumps and motors and more particularly to the management of the intake fluid, the exhaust fluid, the construction and operation of vanes and the construction and operation of the inner sleeve against which the vanes run.

2. Related Art

Positive displacement rotary pumps are designed to transport fluid by drawing in the fluid on a low-pressure suction side of the pump and expelling the fluid on a discharge side under higher pressure through relative movement of pumping elements of the pump. Positive displacement rotary engines are designed to intake high pressure fluid on an intake side of the engine to drive the rotor and output shaft and the fluid is expelled under lower pressure on the exhaust side.

One type of positive displacement pump is a so-called vane pump, which typically includes a rotor housed within a pump housing and supporting a series of moveable vanes. The rotor rotates about an axis that is eccentric relative to an inner ring surface of the housing and is closed at the sides by a pair of housing end plates. The geometries of the offset rotor and inner ring surface create a crescent-shaped space that is narrowest at a close point where the surfaces nearly touch. The space progressively widens away from the close point along a suction side of the pump before transitioning onto the discharge side where the space then progressively narrows as it moves toward the close point. A fluid intake suction port is provided on the suction side and is in communication with a portion the widening space, whereas a fluid discharge port is provided on the discharge side in communication with a portion of the narrowing space. The moveable vanes are caused to move outwardly and inwardly relative to the rotor during operation of the pump so as to maintain engagement with the eccentric inner ring surface. As the vanes sweep along the suction port, a fluid such as air, is caused to be drawn into the space and when the vanes move past the suction port a fixed amount of the fluid becomes captured in a series of chambers defined between adjacent pairs of the vanes which transport the fluid toward the discharge side of the pump. When the fluid progresses to the discharge side, the narrowing of the space between the rotor and inner wall causes the fluid trapped in the chambers to progressively increase in pressure before being expelled out of the pump through the discharge port.

There are also sliding vane motors in which high pressure fluid enters the housing and interacts with the expanding chambers of the vanes to drive the rotor and an output shaft coupled to the rotor.

There is a certain amount of friction associated with positive displacement vane pumps and motors that can lead to a buildup of heat in the parts, including the rotor, which may act as a heat sink due to its mass. This can lead to undesirable expansion of the rotor and potential binding of the moveable parts, if not properly managed. High friction also decreases the efficiency of pumps and motors.

The liner for of the pump housing make take the form of a ring. It is known for vane pumps to provide the inner ring as a stationary component, which is fixed to the housing in the form of an immovable liner. It is also known to support the liner of a vane pump with rolling elements or bearings so that the liner can rotate relative to the stationary housing during operation of the pump. Liners supported by rolling elements help reduce friction compared to fixed liners, but add several parts to the assembly and can be noisy.

Traditional vanes for rotary vane pumps are rigid plate-like elements that fit into radial slots of the rotor and slide in and out with rotation of the rotor to maintain contact with the housing sleeve at the tips of the vanes. Other vane types include hinged vanes, which swing in and out to maintain engagement with the liner. Both types have their limitations, as in each case, the vanes can allow a certain amount of high pressure fluid past the sealing point of the vane as it sweeps past the close point. Such leakage leads to a loss in efficiency of the pump.

SUMMARY

According to one aspect, a positive displacement rotary vane pump includes a pump housing with a suction port on a suction side of the pump and a discharge port on a discharge side of the pump. The pump includes a pump housing and pumping elements which create chambers of increasing volume on the suction side and decreasing volume on the discharge side. The chambers of increasing volume draw in and capture fluid from the suction port and as the pumping elements rotate the captured fluid is transported to the discharge side and progressively pressurized as the chambers decrease in volume as they approach a close point of the pump. The discharge port communicates with a leading chamber on the discharge side having relatively high fluid pressure and at least one trailing chamber of relatively lower fluid pressure. The fluid intake is advantageously routed through openings in the rotor and then directed to the chambers of increasing volume. The fluid intake is typically at a temperature different than that of the rotor and by directing the flow path through the rotor a beneficial heat exchange effect is recognized. If the intake fluid is relatively cool, for example, the rotor can give up some of its heat to the fluid before passing into the chambers. This has the beneficial effect of cooling the rotor which may improve its performance. It has the beneficial effect also of scavenging heat from the rotor to pre-heat the fluid before entry into the expanding chamber, in the case of applications where expulsion of heated fluid from the pump is desirable.

Another feature comprises provision of an inner ring that lines the housing and is supported for rotation relative to both the housing and rotor. The rotational support of the liner ring is achieved without roller elements in the case of a pump (i.e., there are no roller ballers or needle bearings, etc.). Rather, there is a small clearance between the inner ring and housing in which an oil film is maintained under pressure. According to a further advantageous feature, a pocket is provided in the housing in the vicinity of the close point and oil is fed into this pocket under pressure to support the liner ring for rotation relative to the housing and rotor.

According to still a further advantageous feature, the oil in the pocket is maintained at the same fluid pressure as the pressure of the fluid in the pumping chamber adjacent the close point such that the liner ring is pressure balanced and floats at the location of highest load. According to still a further feature, the oil is fed to the pocket under pressure without use of a separate pump or other means external or internal to the rotary pump. According to still a further feature, the oil fed to the pocket is derived from the lubricant source used to lubricate other moving parts of the rotary pump. In particular, the pumping effect of the oil supply to the pocket is achieved by directing the exhaust stream of the rotary pump into an oil sump to create a pressurized environment equal to the pressure of the fluid expelled at the close point. The pressure in the sump forces a small amount of the oil in the sump into the pocket though a supply passage linking the pocket to the sump. In this manner, the outer surface of the liner ring is supported by a film of oil under the same pressure as the fluid pressing against the inner surface of the liner and the liner is able to rotate without physical bearings and with small clearance for a smooth and quiet operation. According to a further advantageous feature, the desired pressure balance on the inner and outer sides of the ring liner can be tuned by adjusting the shape and size of the pocket to achieve more or less pressure on the outside of the ring countering the pressure on the inside.

According to a further advantageous feature, the vanes are configured as leaf vanes and they are provided in large number to reduce the loading on the vanes by sharing the load among many vanes. The numerous vanes also decrease the chances of high pressure escaping past the vanes from the high pressure side to the low pressure side of the pump or motor. The leaf vanes are very thin and have a hooked mounting end that fits in an undercut slots of the rotor for low-friction swinging between a folded position against the rotor and an outward position against the inner wall of the pump or motor. The light weight leaf vanes provide low inertia and low friction. The leaf vanes are arranged on the rotor to be very close to one another. Preferably, the length of a main body of the leaf vane that extends from the mounting portion is about equal to or greater than the spacing between leaf vanes. Even more preferably, especially in the application of a motor, the leaf vanes are close enough together that the main body portion of each leaf vane overlaps onto the main body portion of the adjacent leaf vane when in the folded condition.

In the case of a pump, the leaf vanes may include a bi-directional sealing feature that engages the inner wall to seal both ahead of the vane and behind the vane to expel pressurized fluid through the outlet ahead of the vane while sealing the leading edge of the vane against leakage from high pressure training fluid. According to one embodiment, the bi-directional sealing of the vanes is achieved by having a leaf vane or swing vane with a leading edge that seals against the liner ring and pushes fluid ahead of the leading surface of the vane. A secondary seal trails behind the primary seal and projects in the opposite direction. The secondary seal functions as a flapper-type valve by resisting the passage of high pressure trailing fluid beyond the secondary seal so that the primary seal is guarded from exposure to such trailing fluid. The secondary seal is flexible and projects toward the trailing chamber opposite the primary seal and when encountering the high pressure trailing fluid the secondary seal is caused to be pressed against the sealing liner ring, preventing the fluid from reaching the primary seal and thus passing to the intake expansion side of the pump.

The flow control valve make take different forms and may comprise, for example, one or more reed-type valves that overlie a discharge port in an end plate of the housing. As fluid pressure builds in each of the discharge chambers toward movement to the close point, the positive pressure on one the chamber side of the reed pushes the reed out of sealed contact and permits the fluid to pass into the outlet port. The reed valve (or portion thereof) associated with the one or more trailing discharge chambers remains closed to the extent the pressure on the discharge port side exceeds that of the pressure in the trailing chambers, thus precluding high pressure fluid from backing up into the trailing chambers. When the pressure in the trailing chambers builds to the point where it exceeds the pressure seen on the opposite discharge side of the reed valve, the reed valve is caused to open and let the fluid pass out of the trailing chamber.

Another form of a flow control valve may comprise individual valves fitted on the rotor and associated with each chamber. In the area between adjacent vanes (i.e., in each of the chambers), the rotor can include an outlet that communicates with the discharge port when the associated chamber is rotated to suction side of the pump. When the pressure builds in the chambers sufficiently high to overcome the closing force of the valve, the valve in such chamber opens and releases the pressurized fluid from that chamber. The valves in the other trailing chambers remained closed, so that no fluid from the leading chamber can back up into the trailing chambers, and only open when the pressure in the trailing chambers exceeds the outlet port chamber on the opposite side of the associated valve.

The flow control valve system thus retains all of the benefits of positive displacement rotary pumps while reducing or eliminating the inefficiencies associated with the backflow of high pressure fluid from the higher pressure leading chambers flowing into the trailing chambers. The valve system acts to seal each of the discharge chambers from any inflow of pressurized fluids from the discharge port. The valve(s) open only when the pressure in any given discharge port exceeds the closing force of the valve(s), attributed principally to the higher pressure fluid in the discharge chamber acting on the back of the valve(s) in the trailing chambers. In other words, the valve(s) are unidirectional or one-way in design and operation and prevent high pressure fluid that has been pumped out of a leading chamber from contacting the trailing chambers. The one-way valve(s) could be a reed valve, a flap valve, a ball valve or other types of valves that would achieve the intended purpose.

THE DRAWINGS

These and other features and advantages of embodiments of the invention will become better understood when considered in connection with the following representative drawings and detailed description of preferred embodiments, in which.

Figure 7:
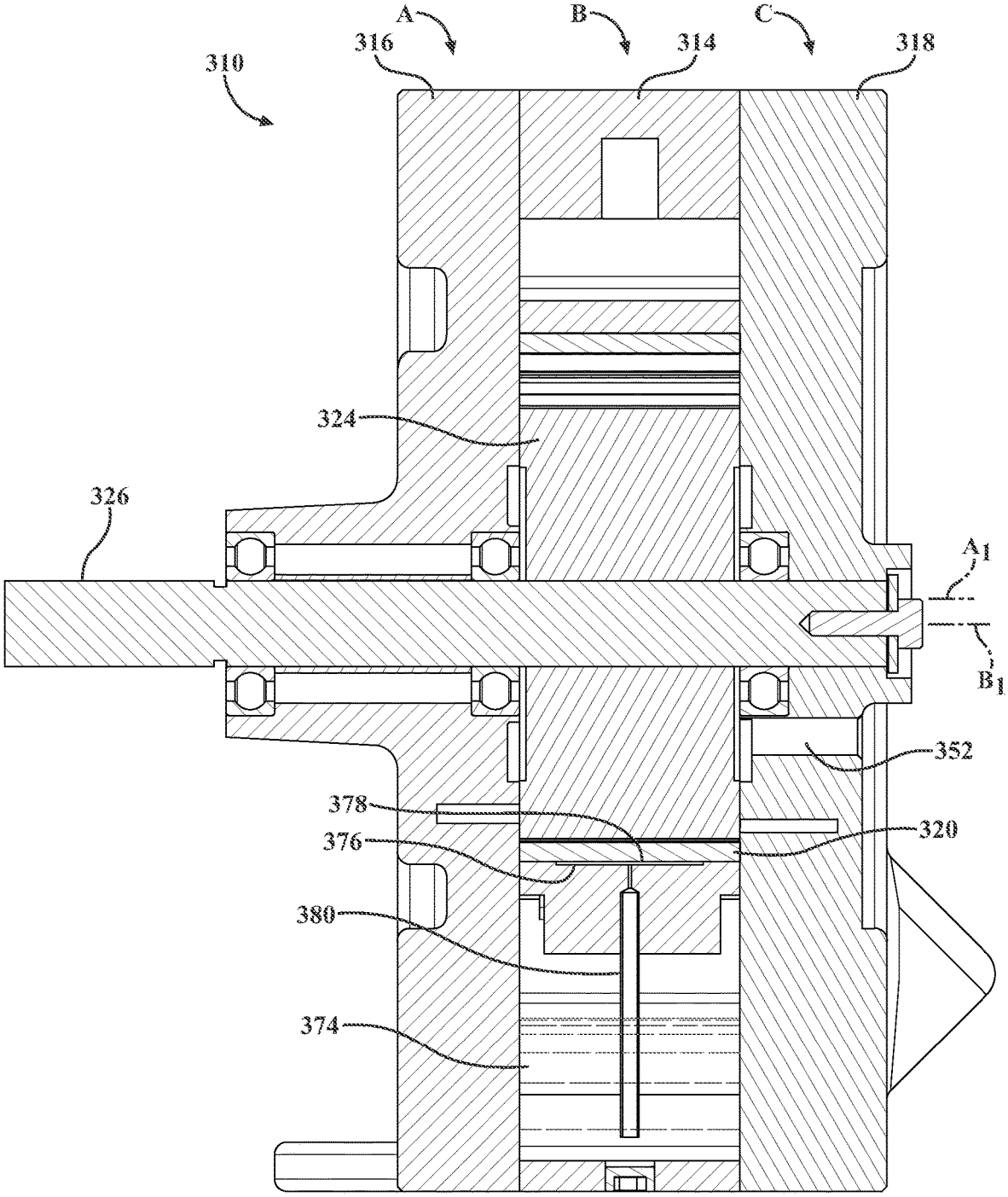
FIG. 7 is a cross sectional view taken along lines 7-7 of FIG. 5.
Figure 8B:
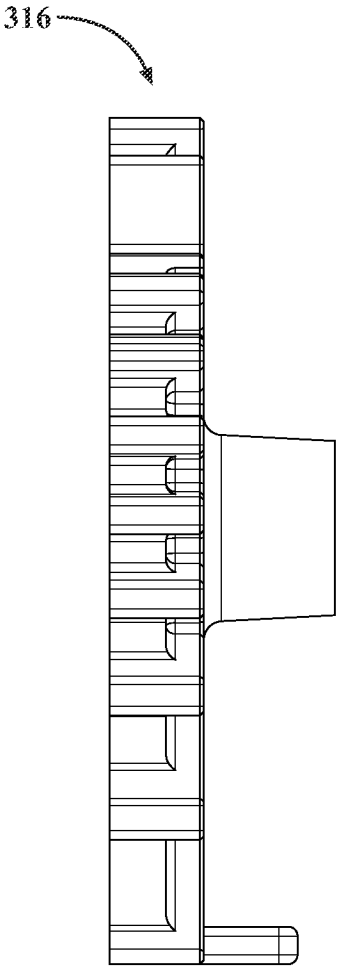
Figure 8A:
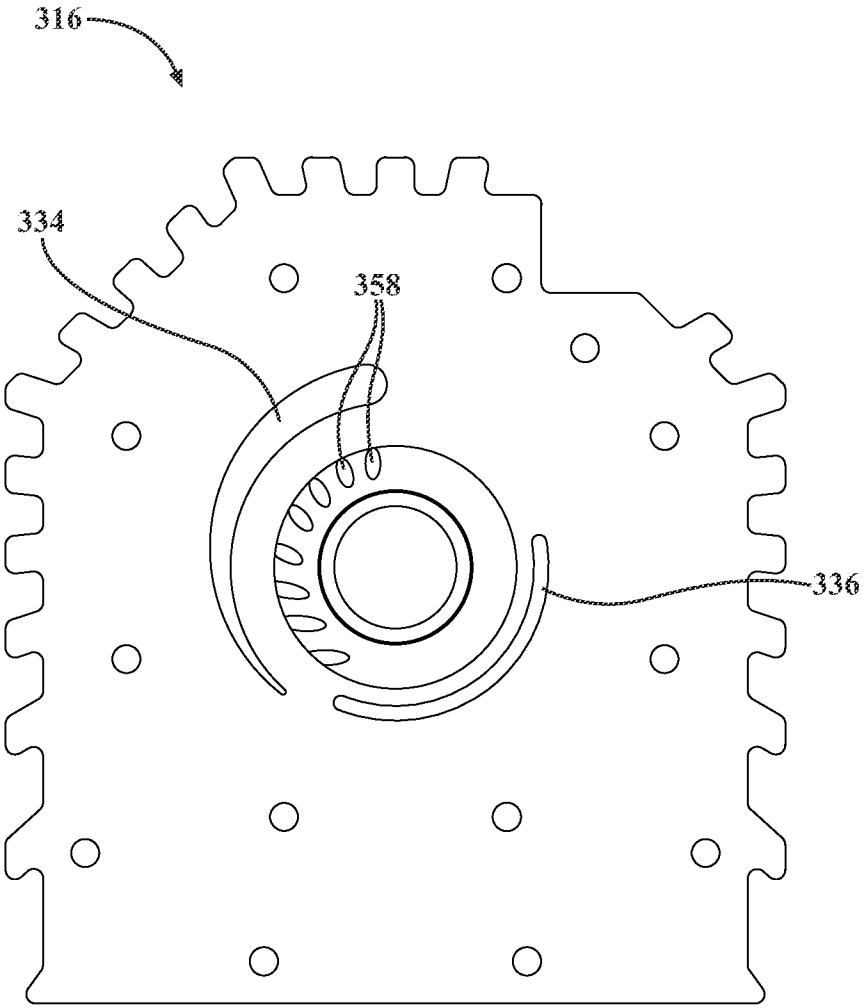
Figure 8D:
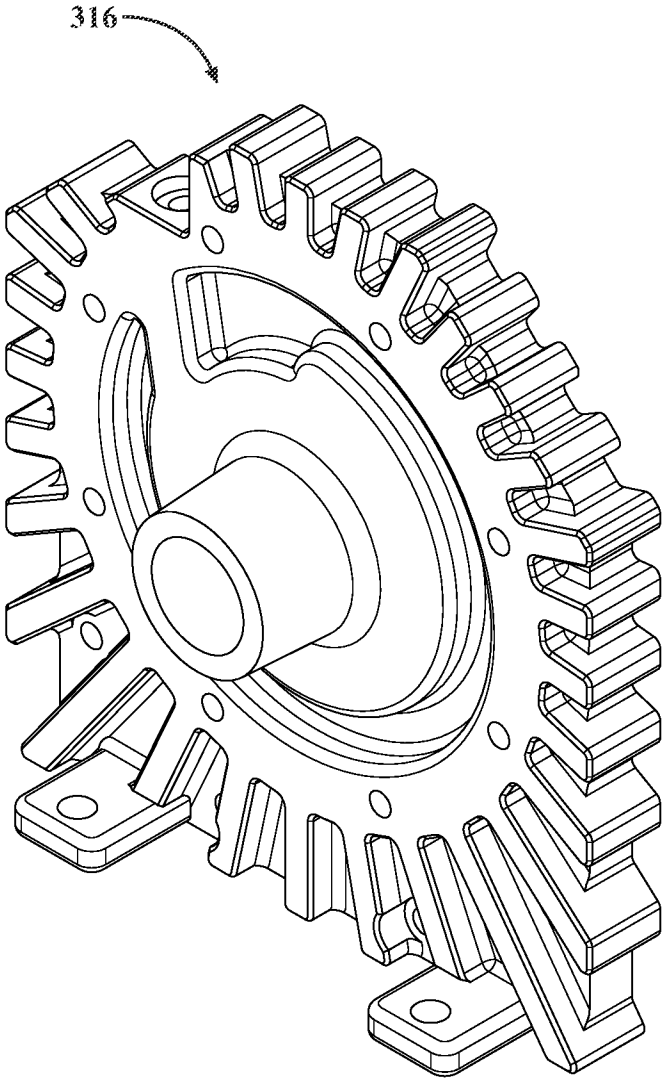
Figure 8C:
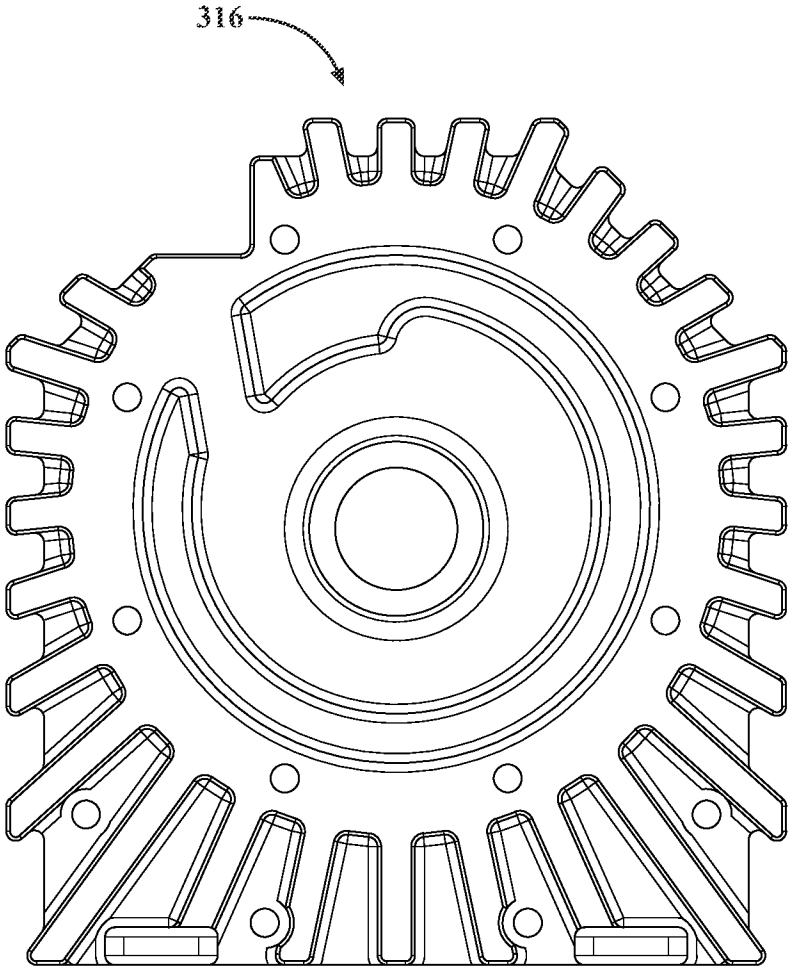
Figure 9C:
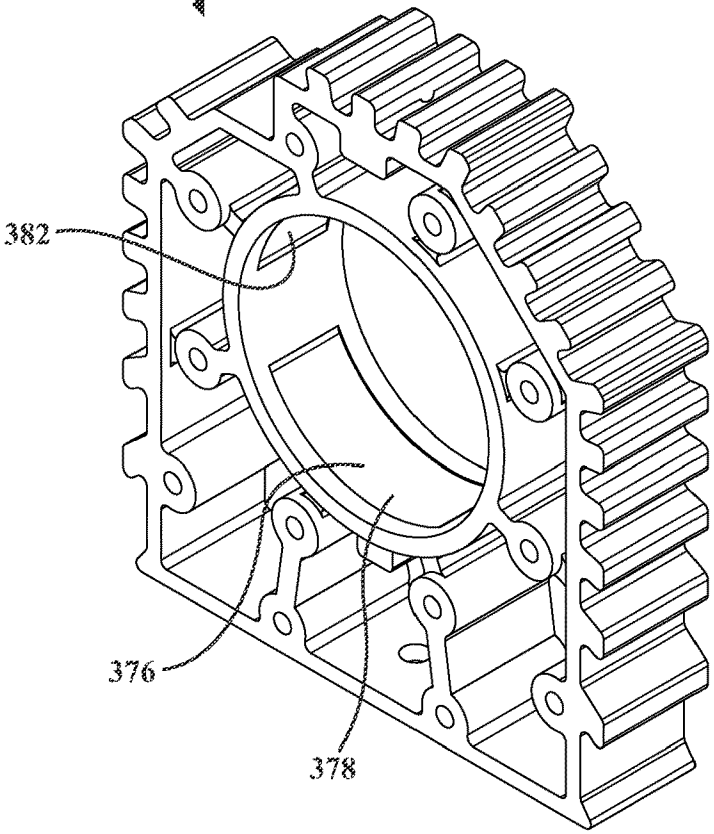
Figure 9B:
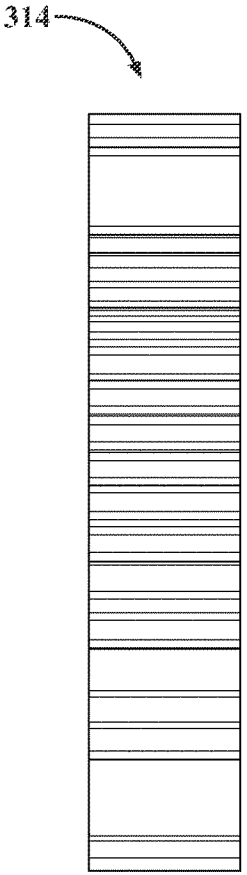
Figure 9A:
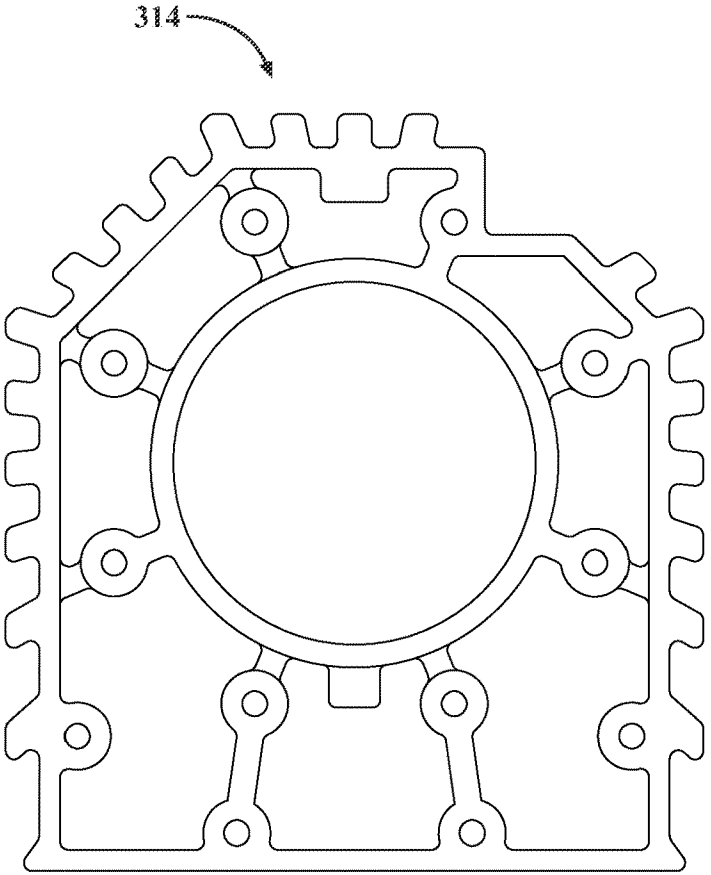
Figure 10B:
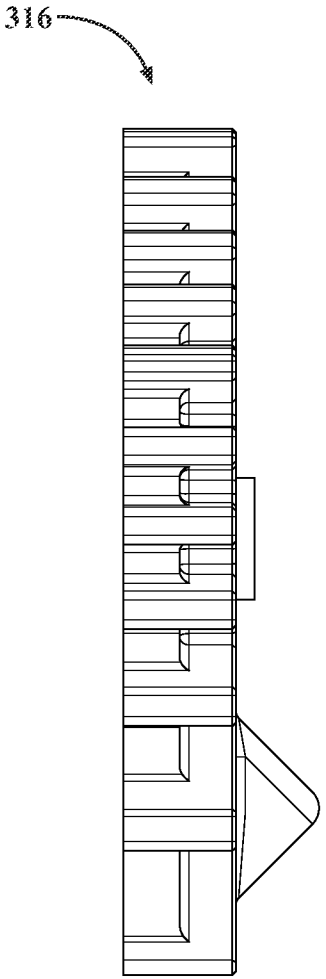
Figure 10A:
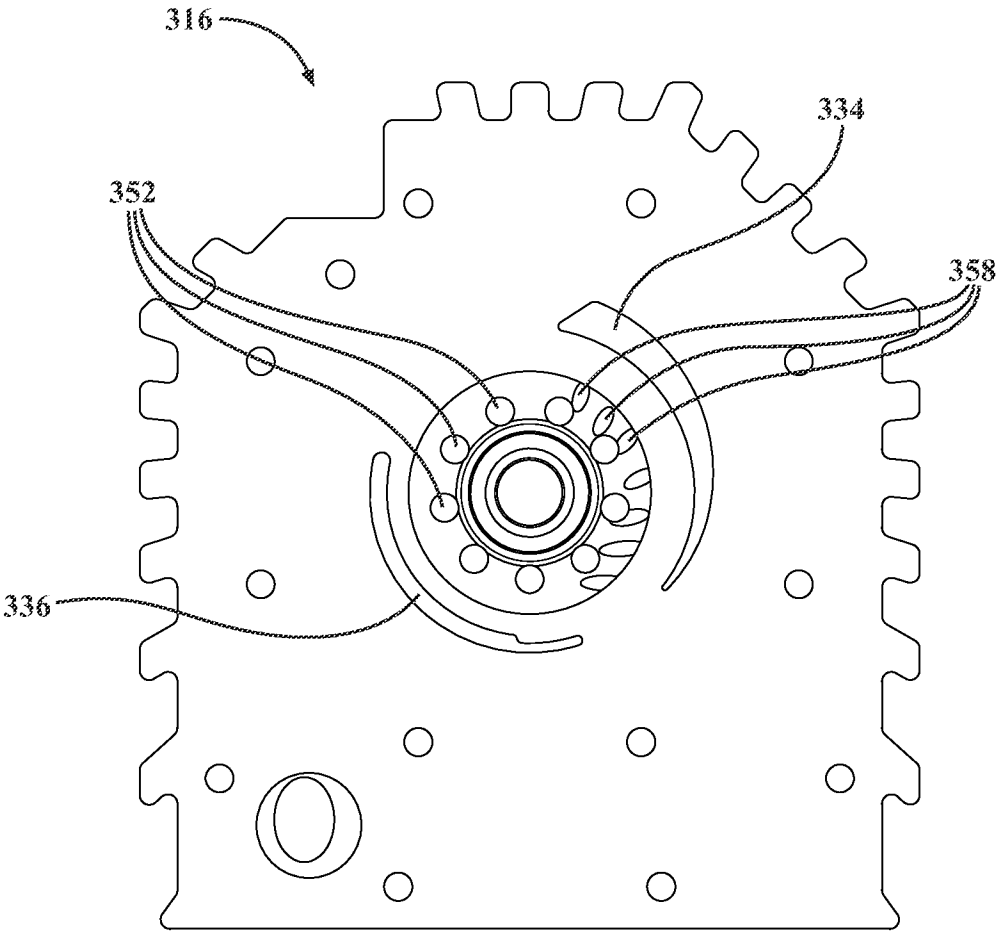
Figure 10D:
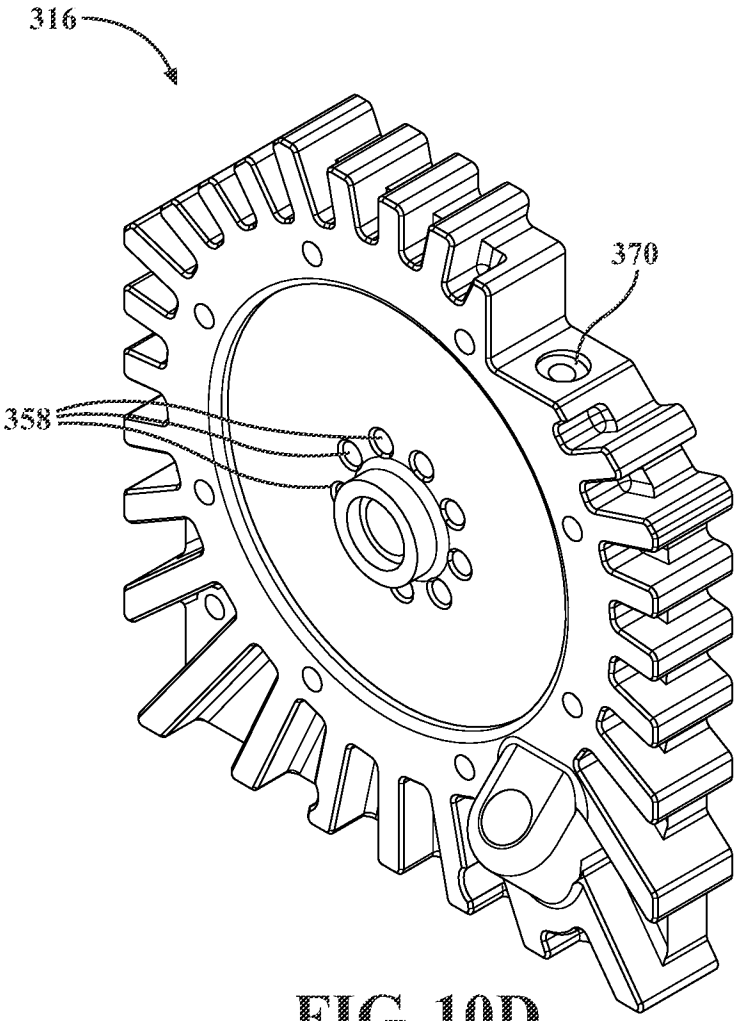
Figure 10C:
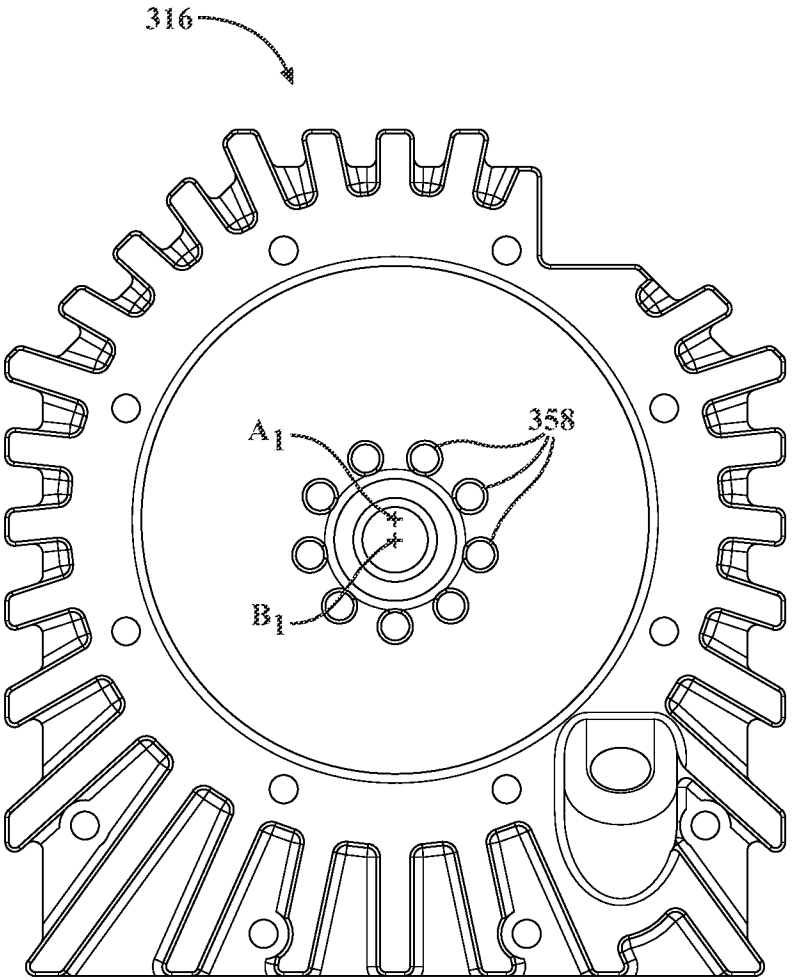
Figure 11:
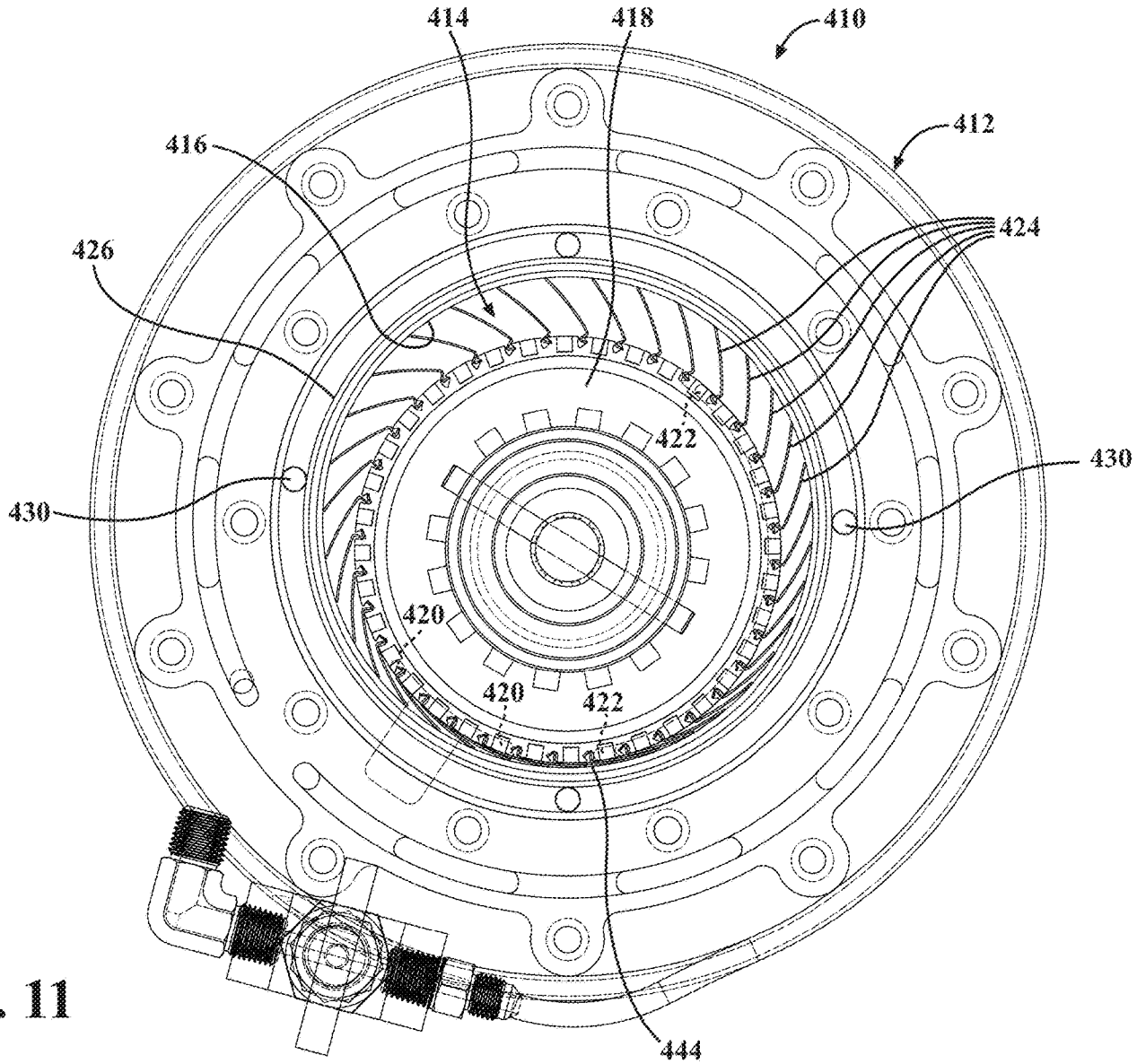
Figure 12:
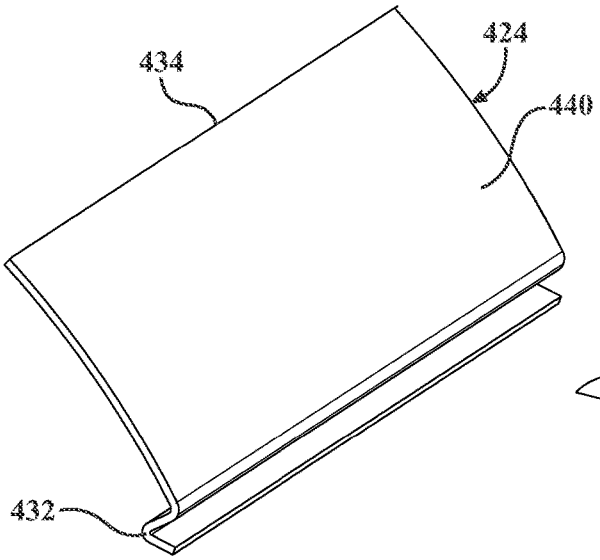
Figure 13:
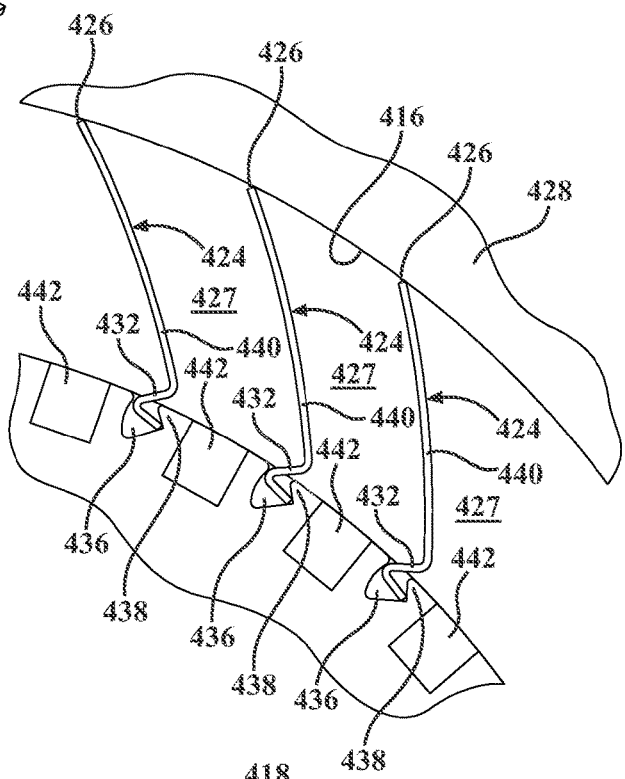
Figure 14:
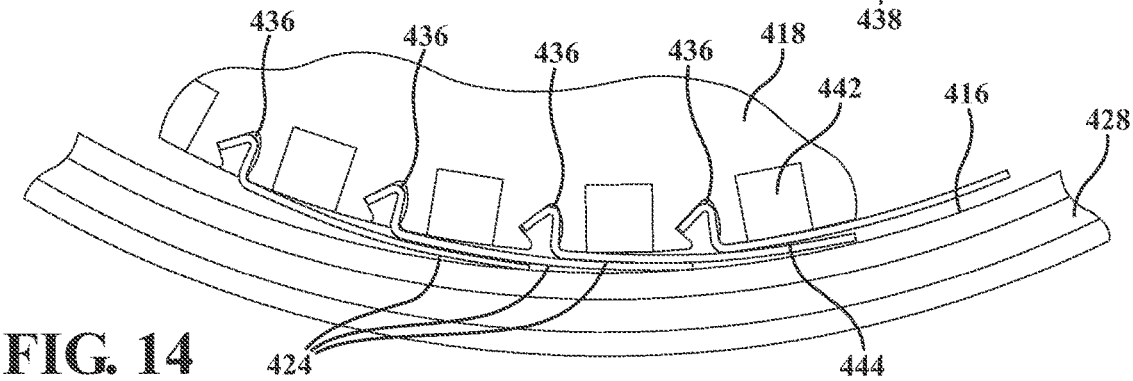

FIG. 8A-D are views of a first end plate indicated at "A" in FIG. 7;

FIGS. 9A-c are views of a housing body indicated at "B" in FIG. 7;

FIGS. 10A-D are views of a second end plate indicated at "C" in FIG. 7;

FIG. 11 is an embodiment of a rotary vane motor;

FIG. 12 is a perspective view of a leaf vane of FIG. 11;

FIGS. 13 and 14 are enlarged fragmentary views of FIG. 11; and

Figure 15:
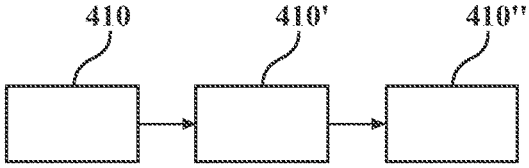

FIG. 15 is a schematic diagram of a multi-motor assembly.

DETAILED DESCRIPTION

Figure 1:
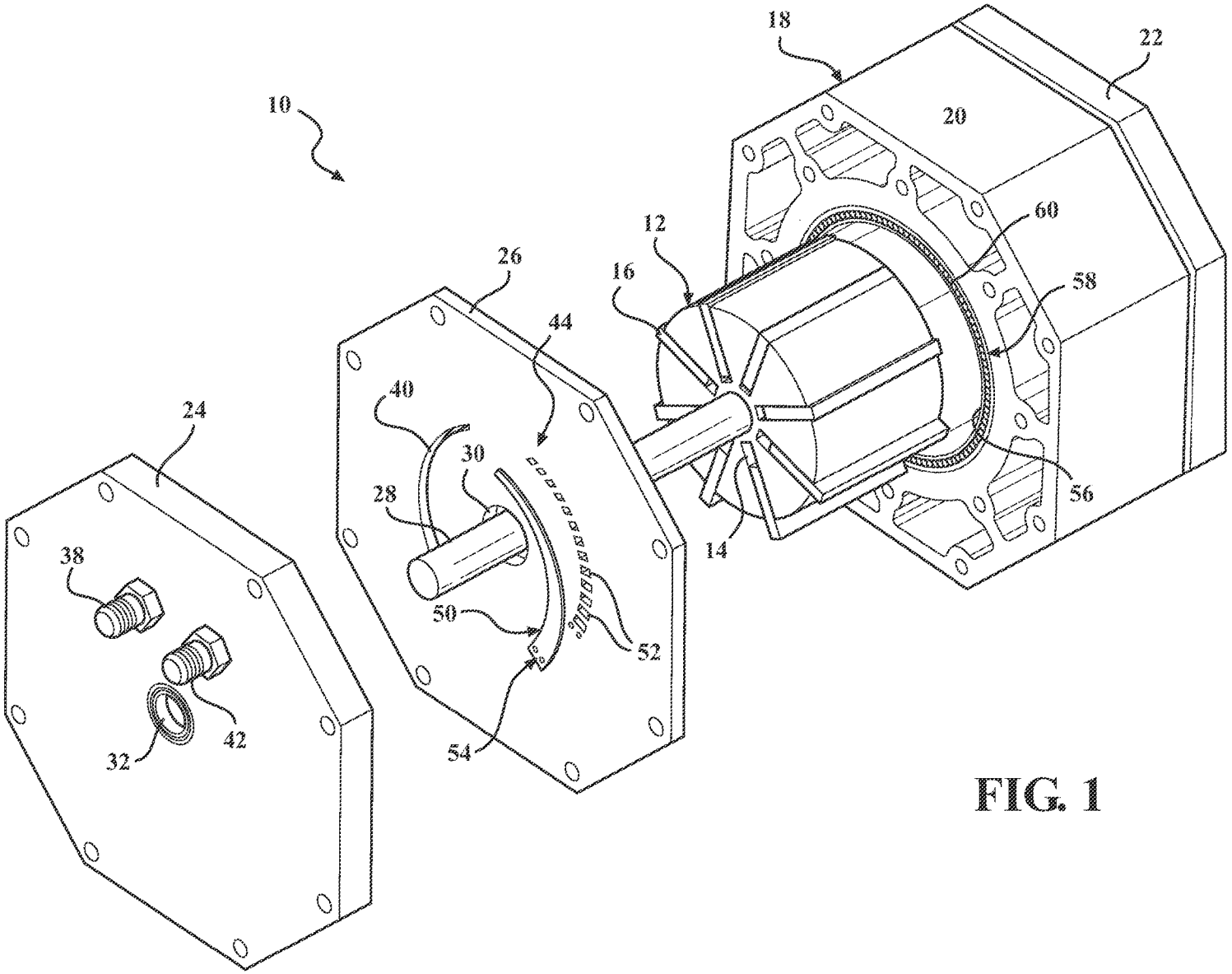
FIG. 1 is an exploded fragmentary perspective view according to an embodiment.

FIG. 1 illustrates a positive displacement rotary pump 10 constructed according to a first exemplary embodiment. The pump 10 of this embodiment is a sliding vane pump and includes a rotor 12 having a plurality of radial slots 14 in which a corresponding plurality of vanes 16 are supported. The pump 10 includes a housing 18 having an inner wall 20 that has an associated inner wall axis. The housing 18 is closed at its opposite axial ends. As illustrated, the housing 18 may be closed at back end by a first end plate 22. The opposite front end of the housing 18 may be closed by a second end plate 24 and an intervening valve plate 26.

Figure 2:
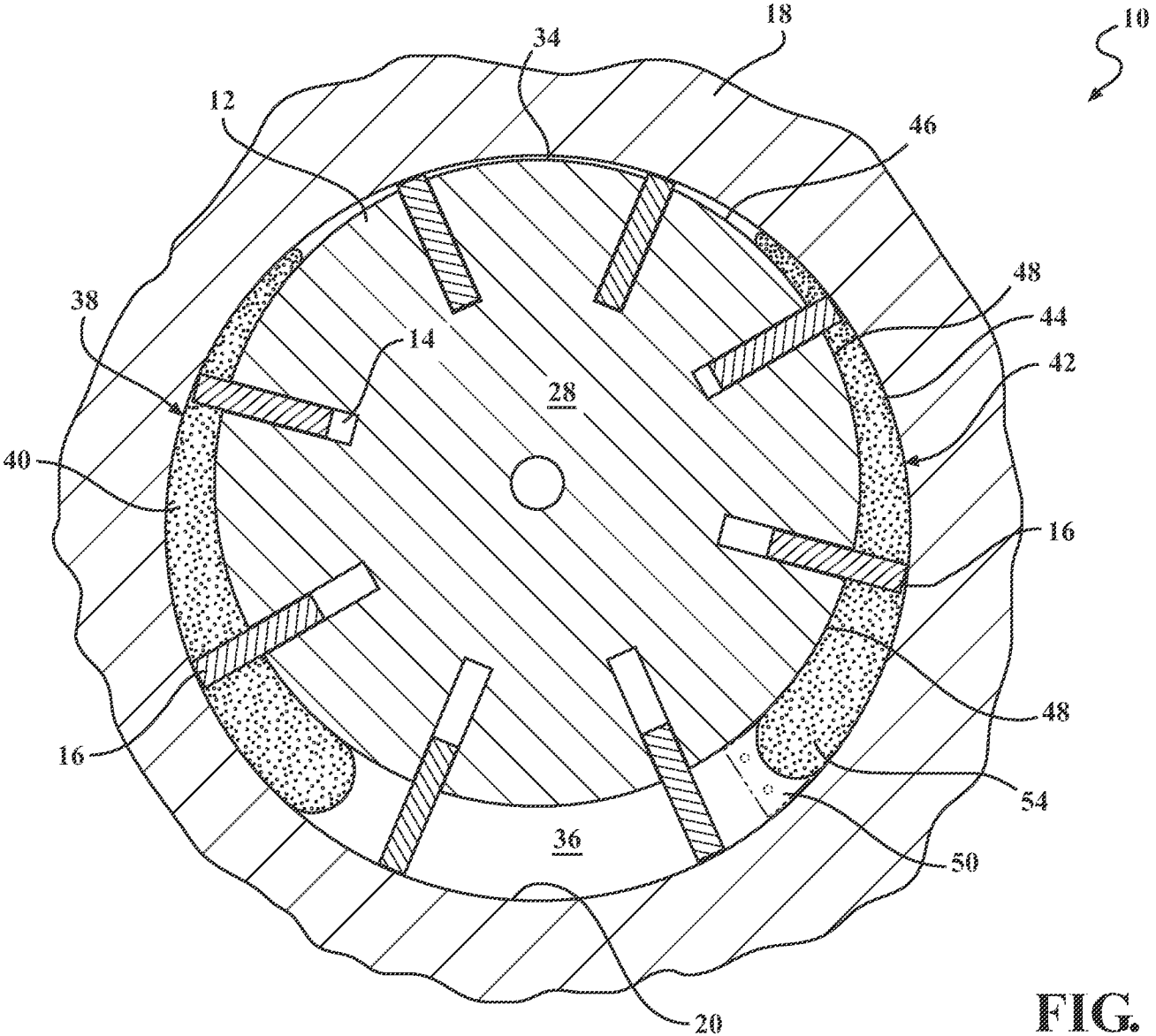
FIG. 2 is a fragmentary cross-sectional view of FIG. 1.

The rotor 12 is mounted on a shaft 28 that extends through an opening 30 in the valve plate 26 and which is supported for driven rotation about a rotor axis by external means, such as a motor or engine. The shaft 28 is suitably supported by at least one and preferably both end plates with bearing(s) 32. The rotor 12 may extend through one of the end plates 24 for engagement by the driving mechanism. The rotor 12 and vanes 16 are disposed within the space defined by the inner wall 20 and end plates 22, 24 and intervening valve plate 26. The axis of the rotor is offset eccentrically relative to the inner wall axis. Both the outer surface of the rotor 12 and the inner wall 20 of the housing 18 are preferably cylindrical and with that of the rotor 12 being smaller in diameter and axially offset but with their respective surfaces arranged very close together at a close point 34 of the pump 10. The geometries and offset placement define a crescent-shaped space 36 between the rotor 12 and inner wall 20 that is near zero in clearance at the close point 34 and widest opposite the close point, as illustrated also in FIG. 2.

The pump 10 includes a fluid inlet 38 that communicates with a part-crescent-shaped inlet port 40 of the valve plate 26. The pump further includes a fluid outlet 42 that communicates with a fluid outlet port 44 of the valve plate 26. The direction of rotation of the shaft 28 in the illustrated pump 10 of FIG. 1 is counterclockwise. With rotation of the rotor 12, the vanes 16 are caused to slide outward in their slots 14 and engage and keep contact with the inner wall 20 during operation of the pump 10. As the vanes sweep by the elongated inlet port 40, a suction is created which draws fluid (such as air) into the pump 10 As the vanes move past the inlet port 40, a fixed amount of air is trapped between the adjacent pair of vanes 16 that have just swept by, the plates 22, 24, 26, the rotor 12 and inner wall 20. As the rotor 12 continues to rotate, the entrapped fluid is transported by the moving chamber from the inlet or suction side of the pump 10 to the outlet or discharge side of the pump. One the discharge side, the crescent-shaped portion of the space 36 is progressively diminishing in size as rotation moves toward the close point. The trapped fluid is pressurized as the chamber 46 progressively decreases in volume as it moves toward the close point 34. Successive one of the vanes passing by the inlet port 40 entrap subsequent volumes of air in trailing chambers 48. It will be appreciated that the leading-most chamber 46 at or near the close point 34 is smallest in volume and its fluid is under the highest pressure, whereas the one or more trailing chambers 48 have trapped fluid that is under progressively less fluid pressure.

The chambers 46, 48 on the discharge side of the pump 10 are in communication with the discharge port 44, 42. The discharge port 42 is fitted with a control valve 50 that allows pressured fluid to escape from the chambers 46, 48 into the outlet 42, but not to return. The discharge port 44 is preferably segmented such that a plurality discrete openings 52 are a provided that are open to the discharge side of the space 36, but which are walled off from one another by intervening wall segments 54. The valve 50 includes a reed 54 that is secured to an outer surface of the valve plate 26 and which overlies the plurality of openings 52. The reed may comprise a thin piece of metal. The reed is anchored at one end, preferably adjacent the leading end of the series of openings 52 of the discharge port 44. The inlet port 40 is not fitted with a valve.

In operation, high pressure fluid from the leading chamber 46 is expelled into the outlet 42 through corresponding ones of the openings 52 that align with the rotational position of leading chamber 46. The reed valve operates as a one-way or unidirectional valve and allows the high pressure fluid to push the distal portion of the reed 54 away from sealing contact with the valve plate 26 in the region covering the corresponding openings 52 associated with the leading chamber 46. Once expelled, the high pressure fluid from the leading chamber 46 cannot enter the one or more trailing chambers due to the presence of the one-way valve 50. Specifically, the pressure on the back side of the reed valve caused by the high pressure fluid expelled from the leading chamber keeps the reed tight and sealed against the valve plate 26 in the region of the openings 52 associated with the position of the trailing chambers 48. Only when the fluid pressure in a trailing chamber(s) 48 exceeds the pressure exerted on the backside of the reed 54 in that area does the reed 54 deflect and allow the fluid to pass, and even then it is one-way so there is no opportunity for higher pressure fluid from the outlet side to enter the chambers during operation. In this way, the trailing chambers 48 are not subject to counterforces exerted by backflow of higher pressurized fluid expelled from the leading chamber 46 that would otherwise occur if the control valve 50 were not present. Recognized benefits include reduced torque in driving the rotor 12 and improved efficiency and performance of the pump 10.

The reed is preferably one-piece and extends across all of the openings 52. The openings are not all of the same size or volume and narrow in accordance with the dimension of the diminishing crescent-shaped space 36 on the discharge side of the pump. The reed 54 is preferable curved and is widest it is base and progressively narrows toward its free distal end.

The inner wall 20 may take the form of a rotatable element. In particular, the inner wall 20 may be provided as an inner surface of an inner race 56 of a bearing 58 that is mounted in the housing 10. Rolling elements 60 support the inner race for rotation relative to both the housing 18 and the rotor 12. While the vanes 16 still slide along the surface of the inner wall 20, the inner wall 20 can also rotate to reduce friction and increase the efficiency of the pump 10.

Figure 3:
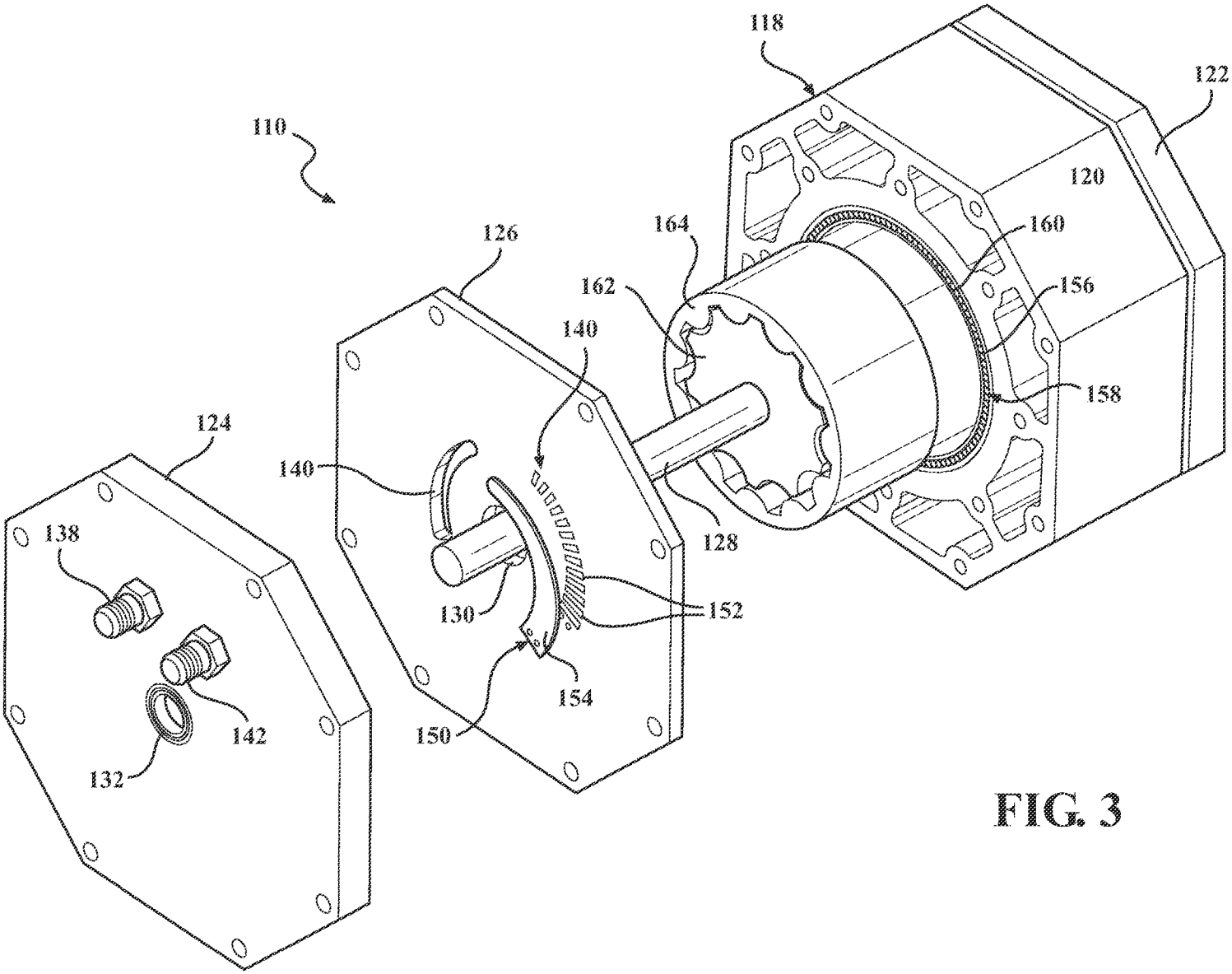
FIG. 3 is an exploded fragmentary perspective view of a positive displacement Gerotor pump according to another embodiment.

FIG. 3 illustrates another embodiment of a positive displacement pump 110 in the form of a Gerotor pump. The same reference numerals are used to represent like parts, but are offset by 100. The pump 10 includes inner and outer Gerotor gears 62, 64 having n and n+1 teeth, respectively. The inner gear is fixed to a rotatable shaft 128 and the axes of the inner and outer gears are offset to define a variable increasing and decreasing volume of space on a suction side and discharge side of the pump 110, respectively. The pump 110 includes a housing 118 with an inner wall 120 that receives the outer surface of the outer gear 64. The inner wall 120 may comprise a bearing 158 that supports the outer gear 64 for rotation relative to the housing 118. The housing 118 has closed ends and includes at least one end plate 124 and an intervening valve plate 26 that may be the same as described above with respect to the pump 10 of the first embodiment, including the inlet and outlet ports 140, 144 and a control valve 50 at the outlet port 144. The outlet port may similarly be segmented as a plurality of successive and discrete openings 152 walled off from one another. The end plate 124 has a fluid inlet 138 communicating with the inlet port 140 on the suction side of the pump 110 and a fluid outlet 142 communicating with the outlet port 144 on the discharge side of the pump 110.

In operation, the rotation of the inner Gerotor gear 62 in the counterclockwise direction about the axis of the shaft 128 drives the outer gear 64 and as the teeth of the gears roll and slide past one another fluid such as air on the suction side of the pump 110 is drawn in to the pump 110 and becomes trapped in chambers that progressively decrease in volume as the chambers progress toward the close point between the gears on the discharge side of the pump 110. As with the vane pump of the first embodiment, the fluid trapped in the leading chamber 146 near the close point 134 is under the highest pressure and the fluid trapped in trailing chambers 148 is under relatively lower pressure. The high pressure fluid is expelled on the discharge side through the outlet port 44. As with the vane pump above, the openings 52 associated with the position of the leading chamber 146 direct the high pressure fluid out of the chamber, past the reed valve 54 and onto the outlet 42. Once expelled, the fluid is not able to return and specifically is not able to backflow to the trailing chambers 148. The same principles, features and benefits associate with the vane pump 10 are realized by the Gerotor pump 110 when outfitted with the control valve 150.

Figure 4:
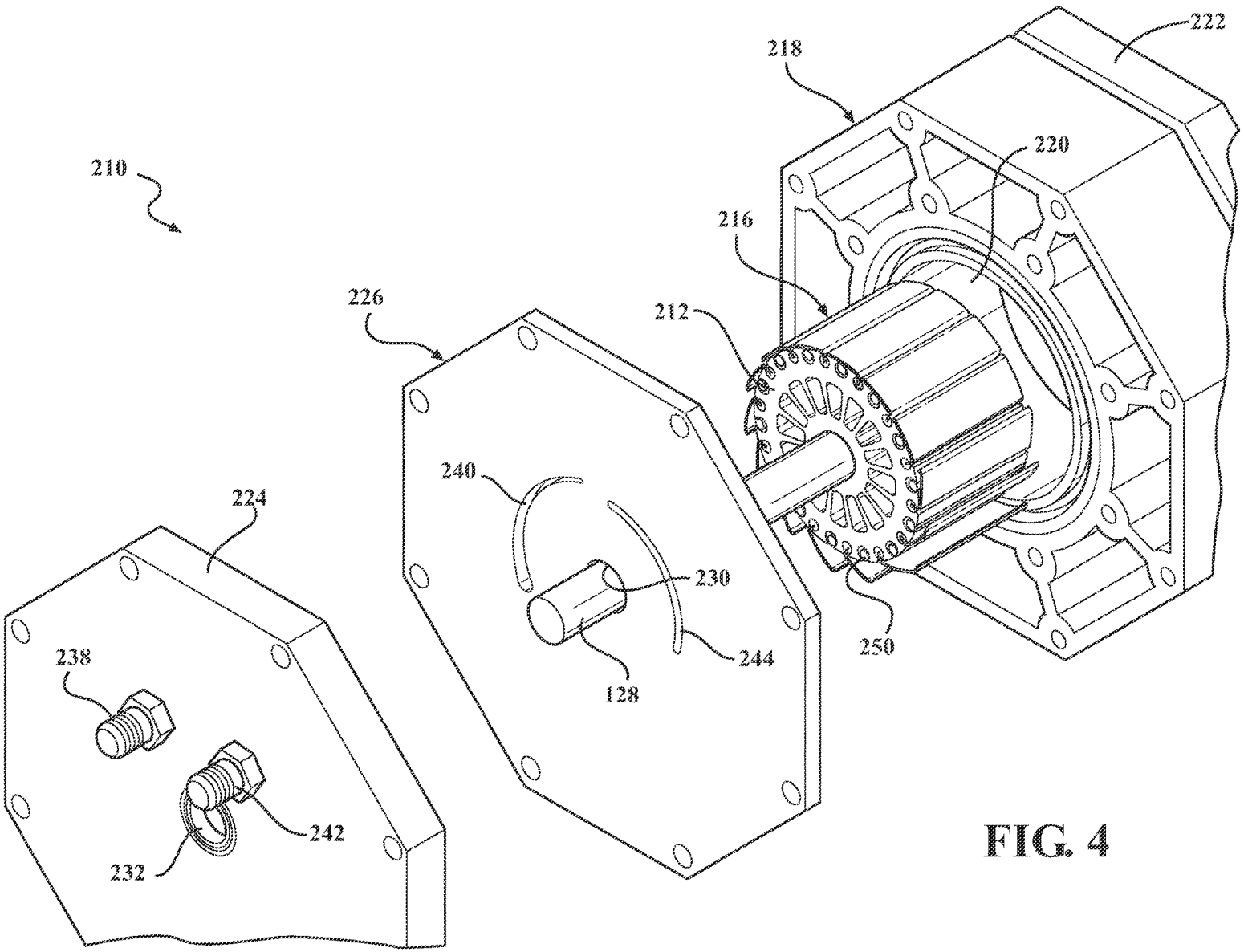
FIG. 4 is an exploded fragmentary cross-sectional view of a positive displacement vane pump according to another embodiment.
Figure 4C:
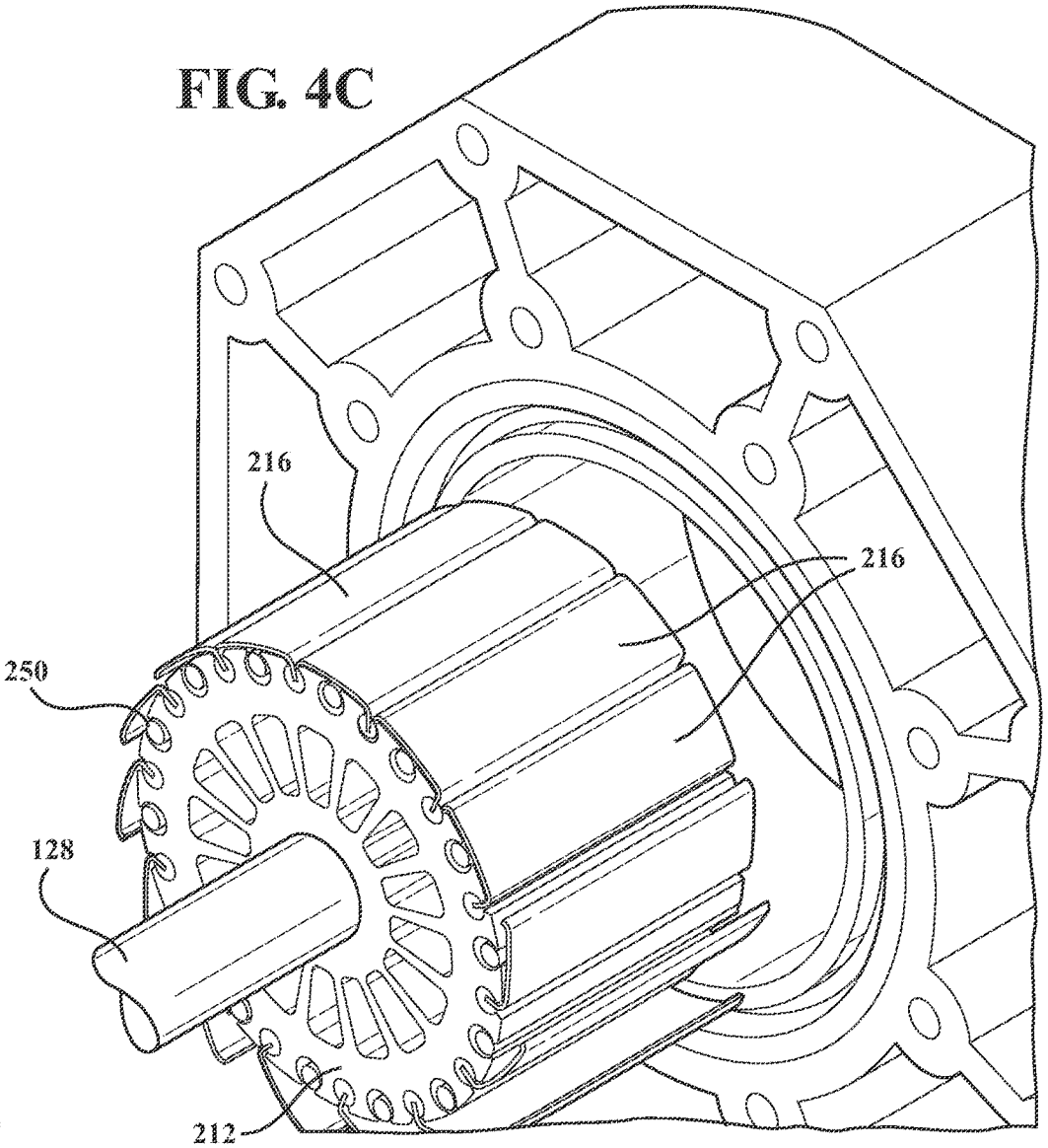
FIGS. 4A, 4B and 4C are enlarged fragmentary perspective views of portions of FIG. 4.
Figure 4A:
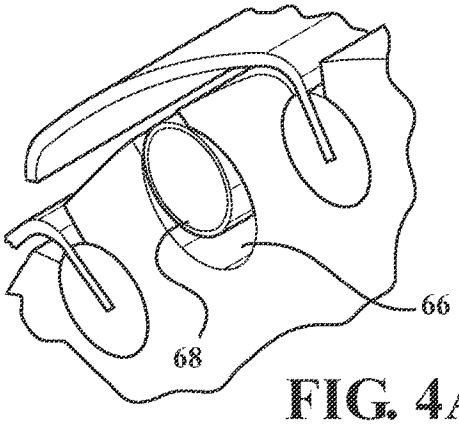
Figure 4B:
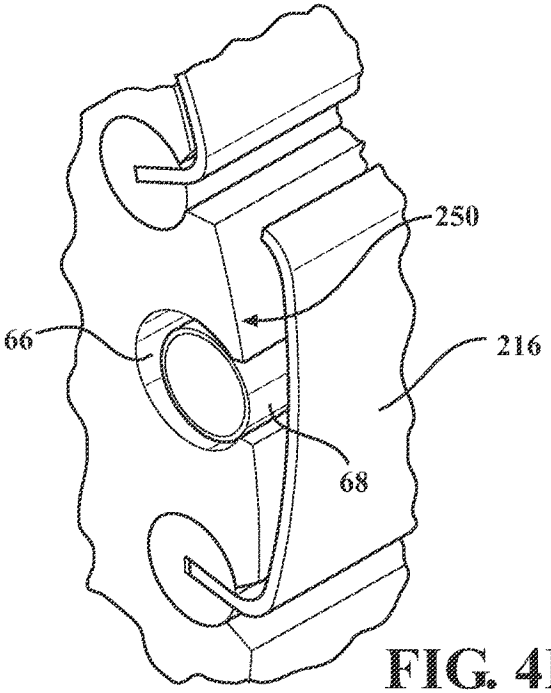

FIG. 4 illustrates an alternative vane pump embodiment. The same numbers are used to represent like features but are offset by 200. The pump 200 includes a rotor 212, a housing 218, inner wall 220, closed ends including end plate 222 and valve plate 226. The vanes 216 in this case are wing vanes supported at their base ends by the rotor 212 for individual rotation relative to the rotor 212. Rather the sliding outward and inward to maintain engagement with the inner wall 220, the wings pivot outwardly and fold inwardly as necessary during movement through the suction and discharge sides of the pump 210.

The control valve 250 includes at least one opening 66 provided in the rotor 220 between each pair of vanes 216 (in other words, each chamber includes an opening 66) and a valve 68 is provided with each opening 66 to enable pressurized air to escape from the chamber into the outlet ports and outlet 42. The openings 66 may comprise slots and the valve 68 may comprise floating cylinders which seat against edge surfaces of the slots to keep the chambers closed until the fluid pressure in the chambers exceeds the holding force provided by the cylinders. The cylinders may span the full width of the rotor or may extend part way. In operation, high pressure fluid in the leading chamber forces the cylinder 68 of that chamber inward allowing the high pressure fluid to escape through the section of discrete openings 252 associated with the position of the leading chamber 246 and out of the pump 210. The valves 68 in the trailing chambers 248 remain closed so long as the backside pressure on the cylinders 68 exceeds the pressure in the trailing chambers 248. The slots 66 are larger than the cylinders 68 such that there is room below the cylinder for the cylinders 68 to move. The slots 66 are in communication with the discrete openings 252 and communicate fluid only so long as the associated cylinder 68 is open. The same feature, principles and advantages apply to this embodiment as they do the others.

Figure 5:
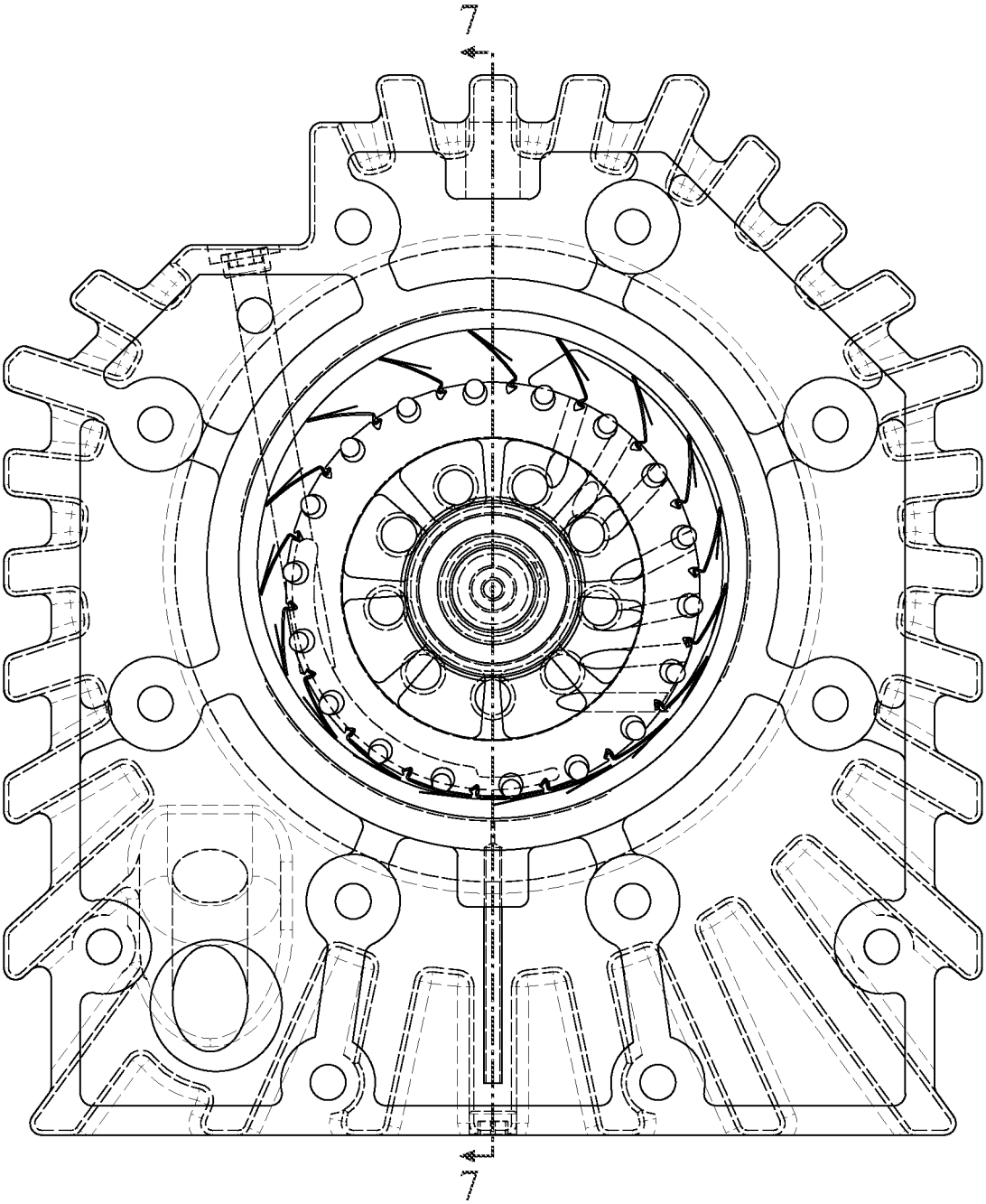
FIG. 5 is a side view of an alternative embodiment.
Figure 6:
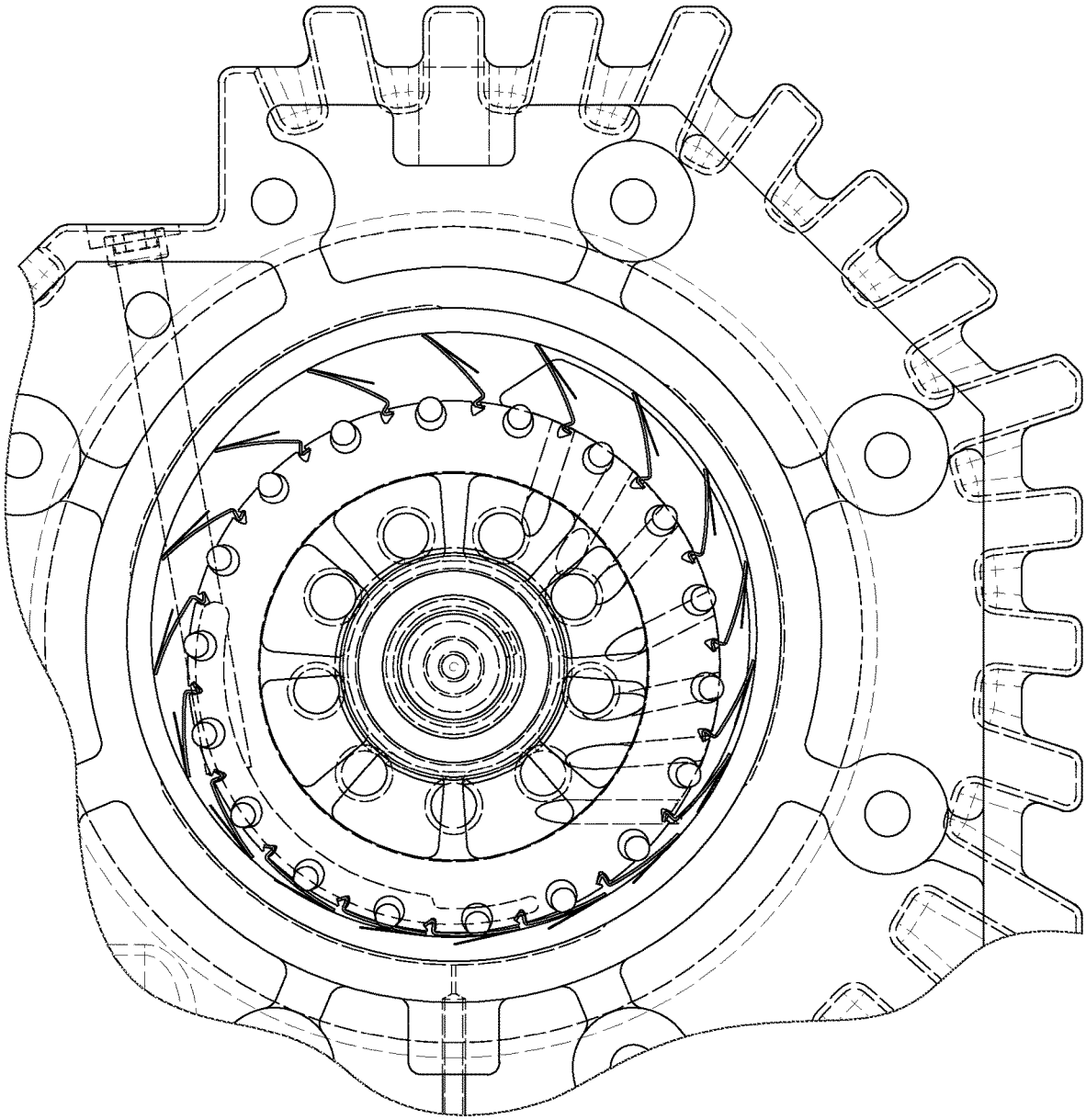
FIG. 6 is an enlarged view of a portion of FIG. 5.

FIGS. 5-7 illustrate an alternative embodiment of a vane-type fluid pump, indicated generally at 310, and FIGS. 8A-D, 9A-C and 10A-D illustrate details of component parts of the pump 310, to be described in further detail below.

The pump 310 includes a pump housing 312, including a pump body 314, a first end plate 316 and a second opposite end plate 318. The pump housing 312 has an inner cavity formed by the pump body 314, and end plates 316, 318, in which a liner ring 320 is supported for rotation relative to the housing about first axis $A_1$. A rotor 324 is mounted on a shaft 326 and supported within the liner ring 320 for rotation about a second axis Bi that is offset relative to the first axis $A_1$. The inner surface 328 of the liner ring 320 has a diameter larger than that of the rotor 324 and they are positioned at a close point 330 with the outer surface of the rotor 324 spaced from but nearly touching the inner surface 328 of the liner ring 320. From the close point 330, a circumferentially extending crescent-shaped space 332 is provided between the liner ring 320 and the rotor 324. A fluid intake port 334 is provided in at least one and preferably both end plates 316, 318 in communication with the crescent-shaped space 332 on an intake side of the pump 310 to introduce fluid into the space 332, while a fluid exhaust port 316 communicates with the space 332 on the exhaust side of the pump 310 to enable fluid under increased pressure to escape the space 332, enter a sump well 338 to pressurize the sump well 338 and from there leave the pump 310 through an outlet 340.

The rotor 324 carries a plurality of vanes 340. The vanes 340 are each supported at their base 341 end in a respective notch 342 of the rotor 324. There are 18 vanes 340 and 18 notches 342 in the illustrated embodiment. The vanes 340 extend the width of the rotor 324 and each is leaf-like in design, having a main portion 344 projecting from the base 341 to a primary sealing edge 346. The base 341 is bent in a v-shaped form so that the lead end can be received within the notch 342 and hook beneath an undercut ledge 348 of the notch 342. The complimentary shapes of the v-shaped base 341 and notch enable the main portion 344 to swing toward and away from the outer surface of the rotor 324. The main portion 344 is slightly bent but is a little greater than the curvature of the rotor surface. The vanes 340 are stiff, but flexible or resilient, such that the main portion 344 can be forced into conformance with the shape of the outer rotor surface when the vanes 340 are swung inward and the free edge of the v-shaped base 341 engages the undercut ledge 348 such that further inward movement requires bending of the main portion 344. The vanes 340 may also include a secondary portion 350 that commences at the primary seal edge and is angled back toward the base 341 so as to diverge outwardly from but overly the outer surface of the main portion 344. The secondary portion 350 is preferably thinner than the main portion 344. The secondary portion 350 may have a thickness of 0.005-0.007 inches while the main portion may have a thickness of less than 0.1 inches and more preferably less than 0.05 inches, and still more preferably about 0.025 inches. The vanes 340 may be made of any of a number of materials, such as hardened bronze or other suitable metal, non-metal or composite. The thin, light veins 340 offer low inertial and friction and serve to increase the efficiency of the assembly. The secondary portion 350 acts as a secondary seal in the form of a flapper valve. Looking at FIGS. 6 and 7, as the rotor 324 rotates counterclockwise in a pumping direction and the primary seal edge 346 approaches and then passes by the close point 330, pressure in the trailing chamber can act on the primary seal edge 346 causing it to lift away from the liner ring 320 and allow high pressure fluid to pass beneath the primary seal edge 346 into the low pressure side of the pump 310, resulting in a loss of efficiency. The secondary portion 350 prevents this by laying down against the liner ring and extending toward the trailing chamber. Such trailing pressure now acts on the secondary portion 350 instead of the primary seal edge 346 and forces the secondary portion into sealed engagement with the liner ring surface 320. As such, the high pressure fluid is blocked by the secondary portion 350 from leaking past the primary sealing edge 346.

The vanes 340, in a pump application, function on the intake side to create ever expanding volume chambers to draw fluid into the chambers through the intake port 334. The inlet for fluid into the pump 310 is provided in this embodiment by a series of air inlets 352 on the intake end plate 318. These air inlets 352 communicate with air channels 354 provided in the rotor 324 and separated from one another by spokes 356 of the rotor 324. The passage of inlet air through the rotor 324 allows for heat exchange between the air and rotor, with the relatively cool air being heated and the rotor cooled. The may have beneficial effect for both the rotor 324, which is cooled, and the air, which is heated. The air in the channels is routed to the fluid intake ports 334 provide on the inner faces of each of the end plates through a series of drilled intake ports 358, best shown in FIG. 6.

As in the previous embodiment of FIG. 4, as the vanes 340 rotate past the intake port 334 and continue on to the compression side of the pump, the chambers captured between adjacent vanes and the rotor and liner ring are caused to become progressively smaller in volume. When the pressure in a given chamber reaches a predetermined level, the associated valve 360 of the chamber is forced open and the pressurized fluid enters the exhaust port 336. This continues along the length of the exhaust port 336 until the leading vane 340 of a chamber past the close point 330, at which point expansion begins again. Pressurized fluid entering the exhaust port 336 is directed into a drilled passage 362 which is open at 364 to the interior or sump 338 of the pump housing 312. This opening 364 can be seen at about 11:00 in FIG. 5. From there, the pressurized air makes it way counterclockwise around the housing passage through a series of linked drill passages 366 in the internal webbing 368 of the pump housing body 314. An air outlet 370 is provided at a distance away from the opening 364 and walled off from a direct shorter path by intervening solid web 372. This routing allows any oil present in the exhaust air an opportunity to deposit itself onto the webs 365 and passage walls 366 of the housing so as to in effect scrub the air stream of oil. The oil then falls to the bottom of the sump 338 and rejoins the level of oil 374 already maintained in the sump 338 for lubricating the moving parts of the pump 310.

The oil film that supports the liner ring 320 for rotation without assistance from roller elements or bearings comes from the oil 374 in the sump 338. As shown best in FIGS. 5, 6 and 9, the inner wall of the body 314 is formed with an oil pocket 376 which is present at the close point 330. The pocket 376 is shown as generally rectangular in shape and set in from the axial edges of the body 314. The pocket 376 extends from the close point in both directions, but preferably further on the compression side of the pump 310. There is a small opening 378 into the oil pocket 376 which communicates with an oil supply tube 378 extending from the opening 378 down into the oil bath 374 in the sump 338 beneath the surface of the oil. As already described, the sump 338 is under pressure from the exhaust air equal to that of the pressure of the pressurized air escaping from the chambers of the vanes 340 into the discharge port 336. Consequently, the pressure above the oil bath 374 forces an amount of oil to flow through the supply tube 380 and into the oil pocket 376 such that the pressure backing the rotatable liner ring 320 is comparable to the pressure acting on the inside of the ring 320, including in the highest pressure zone near the close point 330. Some of the oil in the pocket 376 is permitted to squeeze out and surround the entirety of the ring 320 as the ring 320 rotates relative to the housing 312. Additional oil pockets 382 may be provided in other regions away from the close point to hold oil and reduce hydrostatic drag that might otherwise result if the pockets 382 were not present. It is expected that each particular application may require fine tuning of the pocket size and placement to achieve the optimal balance of pressure distribution on the outer side of the liner ring 320 to counter the pressure on the inner side so the ring 320 rotates freely and quietly during operation.

FIG. 11 illustrates a cross-section of a rotary vane motor assembly 410 according to a further embodiment. The motor 410 includes a housing 412 having an inner cavity 414 with an inner wall 416 disposed about a first central axis $A_1$. A rotor 418 is disposed in the inner cavity 414 and is rotatable about a second axis A2 that is offset from the first axis $A_1$ to create a variable width space S between the rotor 418 and the inner wall 416. The housing 412 is provided with a fluid intake port 420 that communicates with an intake portion of the space S and a fluid exhaust port 422 that communicates with an exhaust portion of the space S.

The motor 410 further includes a plurality of leaf vanes 424 (which may also be referred to as wing vanes) that are carried by the rotor 418 and moveable between an inward folded condition in which the vanes 424 are swung inwardly toward the rotor 418 and an outward position in which the vanes 424 are swung outwardly from the rotor as needed to maintain engagement of distal ends 426 of the vanes with the inner wall 416 of the cavity 414. The leaf vanes define a plurality of chambers 427 between adjacent vanes 424, the inner wall 416 and the rotor 418 of increasing and decreasing volume during operation of the assembly 410.

The inner wall 416 is preferably defined by the inner surface of a sleeve 428 that is supported for rotation relative to the stationary body of the housing 412 and the rotor 418. In other words, the sleeve 428 rotates relative to both the housing 412 and the rotor 418. In the illustrated embodiment, the inner sleeve 428 is supported for rotation relative to the housing 412 by bearings 430.

The leaf vanes 424 are preferably identically constructed. An embodiment of the leaf vane 424 is illustrated in FIG. 12 where it is seen that it is sheet-like and spans the width of the rotor 418. The vanes 424 each have a mounting portion that connects them to the rotor 418 and a sealing portion that engages the inner wall 416. The mounting portions preferably take the form of hook portions 432 at an inner end of the vanes 424 and the sealing portions are provided by engaging portions 434 at the opposite outward free ends of the vanes 424. The hook portions 432 are preferably V-shaped and the free leg of the "V" engages the rotor 418. More specifically, the rotor 418 is formed with a corresponding plurality of recesses or slots 436 that are open to the outer perimeter of the rotor 418 and also open to at least one and preferably both sides of the rotor 418. The recesses are also open to at least one and preferably both axial ends of the rotor 418 and closed off when assembled by end plates of the housing 412 to accommodate installation of the mounting portions 432 of the veins 424 if desired, rather than mounting the veins from the periphery of the rotor 418. The recesses 436 are undercut to present a ledge, lip or latch 438 which receive and engage the hook portions 432 of the vanes 424 to support them for swinging movement toward and away from the rotor 418. The contact between the hook portion 432 and latch 438 is line contact, such that essentially no resistance is offered when the vanes 424 are swung outwardly due to the minimal line contact engagement area. The recess 436 is shaped to receive the V-shaped mounting portion 432 deeper into the recess 436 when the vanes 424 are swung progressively inward in use and offering little resistance to such inward swinging movement. Under positive fluid pressure, the mounting portion 432 of the vanes seal against the engaging latch portions 438 of the rotor 418. The vanes 424 have a main body portion 440 that each extend from the mounting portion 432 angled away from the direction of rotation. The main body portions 440 are very thin, ranging from 0.010 to 0.100 inches thick and may be made of metal such as stainless steel or brass or bronze, or may be of other materials depending on the pressures and temperatures seen in a given application. The main body portions 440 have a length that is greater than the spacing between adjacent vanes 424, lending to their being numerous vanes 424 spaced such that they overlap one another when in the inwardly folded condition. In one embodiment, the vanes 424 may be spaced 10 degrees apart such that there are 36 vanes 424, but even more vanes may be present in an application having a larger rotor 418. The close spacing enables the load to be distributed among numerous vanes 424 and in turn enables the vanes 424 to be thin and offer low frictional resistance to rotation, and if leakage should occur in any one vane, there are subsequent vanes that can trap the leakage before it gets to the discharge port of the housing. When folded, the main body portion 440 of a given vane 424 overlaps the main body portion 440 of the trailing vane 424, preferably by at least 30% and more preferably by about 50% or more.

The rotor 418 is provided with a plurality of slots 442 that are provided between adjacent pairs the 436 recesses and vanes 424. The slots 442 are open at the peripheral surface of the rotor 418 to the chambers defined between adjacent vanes 424 and selectively communicate with the intake 420 and exhaust 422 ports of the housing 412 depending upon the rotational position of the slot 442 during operation. When aligned with the intake port 420 the slots 442 guide a fluid, such as pressurized steam, into the associated chambers 427 between adjacent leaf vanes 424. The expansive force of the heated pressurized steam drives the leaves 424 and rotor 418 while the volume of the chambers 427 increase as they travel away from the intake port 420 and reach the maximum volume at 180 degrees away (i.e., at 12 o'clock) from the close point 444, as illustrated in FIGS. 11 and 13. The close point 444 is where the rotor 418 is closest to the sleeve 428 and the vanes 424 in the close point region are folded and overlapping, as illustrated in FIGS. 11 and 14. (i.e., at 6 o'clock) of the motor 410. The chambers 427 and slots 442 open to the exhaust port 422 as they pass by the 1 o'clock position and remain open until just before entering the 6 o'clock close point 444 position. The escaping fluid (e.g., pressurized steam) may still be under pressure and still contain heat energy and may be returned to a boiler or used for other purposes, such as subsequent in-line vane motors 410', 410" for example, that may be constructed the same or similar to motor 410 but may be smaller or larger in size and may contain fewer or more vanes, as illustrated schematically, for example, in FIG. 15. The overlapping of the vanes 424 passing through the close point 444 position helps assure that high pressure fluid at the intake port 420 does not leak past the vanes 424 and escape directly to the exhaust port 422. When at the close point 444. A fully folded vein 424 overlaps not only the mounting portion 432 of the trailing vane 424, but also the recess 436 and slot 442 associated with the trailing vane 424. As the overlapped veins 424 pass the close point 444, they begin to unfold and are exposed again to the intake port 420 to repeat the cycle.

The motor assembly 410, with its numerous closely-spaced, light-weight vanes Obviously, many modifications and variations of the present invention are possible in light of the above teachings. It is, therefore, to be understood that the invention may be practiced otherwise than as specifically described while still being within the scope of the invention.

What is claimed is:

1. A vane pump or motor assembly, comprising:

a housing having an inner cavity with an inner wall disposed about a first central axis;

a rotor disposed in the inner cavity and rotatable about a second axis that is offset from the first central axis to create a variable width space between the rotor and the inner wall;

a plurality of vanes moveably carried by the rotor and engaging the inner wall to partition the variable width space into a plurality of chambers of increasing and decreasing volume in response to rotating the rotor; and wherein each vane of the plurality of vanes has a mounting end and a main body portion extending from the mounting end and wherein the rotor includes corresponding recesses that receive of the mounting ends of the vanes and wherein the mounting ends of the vanes engage have at least one edge that engages the recesses with line contact to continually support the vanes for outward and inward swinging motion about a fulcrum defined by the line contact; wherein the vanes are formed of metal sheet material that is elastically deformable.

2. The vane pump or motor assembly of claim 1, wherein the mounting end is V-shaped.

3. The vane pump or motor assembly of claim 2, wherein the recesses are open to at least one side of the rotor for installation of the mounting end and are closed by an end plate of the housing.

4. The vane pump or motor assembly of claim 1, wherein the recesses comprise undercut ledges forming sharp pockets for the V-shaped mounting ends.

5. The vane pump or motor assembly of claim 1, wherein the main body portion has a thickness of 0.010 to 0.125 inches.

6. The vane pump or motor assembly of claim 1, wherein the main body portion of the vanes are foldable flat against the rotor when the vanes pass a close point.

7. The vane pump or motor assembly of claim 6, wherein when folded flat, a distal end of the main body portion is adjacent the mounting end of an adjacent vane.

8. The vane pump or motor assembly of claim 6, wherein when folded flat, a distal end of each main body portion overlaps the main body portion of an adjacent vane.

9. The vane pump or motor assembly of claim 1, including a plurality of fluid passages extending through an outer circumference of the rotor into each of the plurality of chambers between adjacent vanes.

10. The vane pump or motor assembly of claim 1, wherein the inner wall comprises a rotatable sleeve portion of the housing.

11. The vane pump or motor assembly of claim 10, wherein the rotatable sleeve portion is supported for rotation without bearings.

12. The vane pump or motor assembly of claim 11, including a fluid outlet communicating with the variable width space for directing pressurized fluid out of the variable width space, and wherein the fluid outlet is in fluid communication with a space between the rotatable sleeve portion and the housing for pressurizing a backside of the rotatable sleeve portion for rotation.

13. The vane pump or motor assembly of claim 1, wherein a spacing between adjacent vanes is less than a length of the main body portion.

* * * * *